United States Patent [19]

Lloyd-Davies

[11] Patent Number: 4,564,132

[45] Date of Patent: Jan. 14, 1986

[54] FLUID DISPENSING ASSEMBLY

[75] Inventor: William T. Lloyd-Davies, Irvine, Calif.

[73] Assignee: Scholle Corporation, Irvine, Calif.

[21] Appl. No.: 583,380

[22] Filed: Feb. 24, 1984

[51] Int. Cl.[4] ..... B22D 37/00

[52] U.S. Cl. ..... 222/522; 137/630.22; 137/614.04

[58] Field of Search ..... 222/501, 522, 525, 544, 222/546, 548, 105, 92, 524, 509, 505; 137/628, 630.19, 630.22, 231, 614.03, 614.04; 251/149.1

[56] References Cited

U.S. PATENT DOCUMENTS

| | | | |
|---|---|---|---|
| 824,391 | 6/1906 | Toomey | 222/501 |
| 1,328,060 | 1/1920 | Silverman | 222/525 |
| 2,252,543 | 8/1941 | Beeh | 222/501 |
| 2,597,250 | 5/1952 | Kollsman | 226/63 |
| 2,665,037 | 1/1954 | Züblin | 222/490 |
| 2,702,052 | 2/1955 | Grayson | 137/630.22 |
| 2,703,105 | 3/1955 | Stoner | 137/630.19 |
| 2,816,690 | 12/1957 | Lari | 251/149.1 |
| 3,106,321 | 10/1963 | Gorman | 222/394 |
| 3,334,860 | 8/1967 | Bolton, Jr. | 251/149.1 |
| 3,447,722 | 6/1969 | Mason | 137/628 |
| 3,464,436 | 9/1969 | Bruning | 137/237 |
| 3,738,545 | 6/1973 | Roy | 222/525 |
| 3,768,501 | 10/1973 | Elson et al. | 137/231 |
| 3,871,404 | 3/1975 | Courant | 137/614.03 |
| 3,871,422 | 3/1975 | Elson et al. | 137/231 |
| 3,908,864 | 9/1975 | Capper | 222/105 |
| 3,963,147 | 6/1976 | Waters | 222/95 |
| 3,977,569 | 8/1976 | Scholle | 137/688 |
| 4,014,461 | 3/1977 | Harvill | 222/94 |
| 4,137,930 | 2/1979 | Scholle | 222/105 |
| 4,159,790 | 7/1979 | Bailey | 222/211 |
| 4,286,636 | 9/1981 | Credle | 141/114 |
| 4,353,488 | 9/1982 | Schneiter et al. | 222/501 |
| 4,380,310 | 4/1983 | Schneiter et al. | 222/501 |
| 4,421,146 | 12/1983 | Bond et al. | 251/149.1 |

FOREIGN PATENT DOCUMENTS

| | | |
|---|---|---|
| 2341235 | 7/1935 | Australia . |
| 155098 | 2/1954 | Australia . |
| 438454 | 12/1926 | Fed. Rep. of Germany . |

*Primary Examiner*—Joseph J. Rolla
*Assistant Examiner*—Kenneth Noland
*Attorney, Agent, or Firm*—Knobbe, Martens, Olson & Bear

[57] ABSTRACT

A fluid dispensing assembly is disclosed which includes a connector valve and a diaphragmic container valve that permits a fluid dispensing passageway to be connected to a disposable container of fluid in a simple, efficient manner to provide continuous fluid flow. The connector valve engages the container valve to simultaneously open both the container valve and the connector valve in a single connecting step to dispense fluid from the container into the dispensing passageway. Upon disengagement of the valves, both valves simultaneously close. The assembly is simple, lightweight and inexpensive, thereby being particularly suitable for use with lightweight disposable fluid containers.

21 Claims, 6 Drawing Figures

FLUID DISPENSING ASSEMBLY

BACKGROUND OF THE INVENTION

The present invention relates to fluid dispensing assemblies, and, more particularly, to a fluid dispensing assembly for continuous dispensing of fluid from a container into a dispensing passageway.

In the past, a variety of fluid dispensers have been used for continuous dispensing of fluid from a fluid container into a dispensing passageway. One common form of such a dispenser is represented by a dispensing valve system known as the Hansen valve assembly, produced by the Hansen Manufacturing Company of Cleveland, Ohio. The Hansen valve assembly includes a metallic valve mounted on the container discharge port and an engageable similar metallic valve connected to a fluid discharge passageway. The two valves include opposing mutually engageable spring biased bullet types of valve mechanisms which permit fluid flow therethrough upon engagement. Typically, one of the bullet mechanisms includes a male plunger and the other includes a female plunger. As the two mechanisms are engaged, both plungers are displaced, and fluid is allowed to flow from the fluid container through both valve mechanisms to a dispenser passageway.

Though such metallic bullet valve mechanisms have generally been functionally suitable for use with fluid containers which are designed for repeated refilling and reuse, they are expensive. Further, they are not satisfactory for use with disposable containers, particularly disposable containers constructed of lightweight materials., such as disposable bag-in-box containers, which have enjoyed widespread commercial success in recent years. These containers include a cardboard supporting structure (box) and an interior thin wall plastic liquid-proof liner (bag) and are used with a variety of fluids such as wine, juices, soda syrup and the like. Because of the expense of the bullet valve mechanisms, it would be prohibitively costly to dispose of the valves with disposal of the empty containers. On the other hand, removal and reconnection to a fresh container is cumbersome, costly and generally problem oriented. In addition, the force that is required to mutually engage the two valves is too great to be applied to these lightweight containers without producing certain damage to the containers.

While there are a number of satisfactory actuatable demand dispensers available for use on lightweight disposable containers for periodic dispensing of fluid, no satisfactory assemblies have been developed heretofore for continuous fluid dispensing therefrom into a dispensing passageway. Though some dispenser mechanisms have been proposed for this use with disposable containers, those mechanisms have failed to provide the simplicity of operation and construction and reliability provided by the present invention. For example, U.S. Pat. No. 4,421,146, issued Dec. 20, 1983, discloses a cumbersome and complex assembly which utilizes a first connector valve which is slidably mounted in a yoke which, after transverse mounting of the yoke to the container spout, must then be slid to engage a second valve mounted in the container spout. The second valve includes a complex slidable member which must couple with the first valve for joined movement therewith. The complexity of structure and the required sequential operational steps of this device render it generally unsatisfactory and unreliable.

A similar device, which is disclosed in U.S. Pat. No. 4,375,864, issued Mar. 8, 1983, is less cumbersome and complex and requires only a single engagement step and is thus generally more satisfactory and reliable. However, in this device, the connector member is not an actuatable valve which is opened only on engagement with the container valve, and thus the constantly open connector member limits its versatility and poses possible drip problems on disconnection.

Thus, there remains a need for a lightweight, simple, inexpensive and reliable fluid dispensing device for providing continuous fluid dispensing from a container into a fluid passageway which preferably includes two valve members which are opened on, and only on, mutual engagement. The need is particularly great for such a device which is suitable for use with lightweight disposable containers, such as bag-in-box containers.

SUMMARY OF THE INVENTION

The fluid dispensing device disclosed herein meets the need for a lightweight, simple, inexpensive and reliable fluid dispensing device for providing continuous fluid dispensing from a container into a fluid passageway. The device includes a connector valve and a container valve which are preferably opened on, and only on, mutual engagement.

The connector valve is adapted to be in fluid communication with a fluid passageway and the container valve is adapted to be in fluid communication with the container. Upon interconnection of the connector valve and the container valve, fluid is allowed to flow from the container through the valves to the fluid passageway. Preferably, both the connector valve and the container valve are constructed in the form of a cylindrical housing having proximal ends adapted for mutual locking engagement to permit fluid flow therebetween. One of the valve housings is provided with an intermediate transverse wall having at least one fluid opening therein and a valve displacement member extending from the proximal side of the transverse wall. The same valve housing is also provided with a transverse resilient diaphragmic sealing valve member mounted adjacent the transverse wall and in sealing engagement therewith to normally prevent fluid flow through the transverse wall opening. The diaphragmic valve member is provided with at least one fluid opening therein radially displaced from the transverse wall opening. The same valve housing is also provided with a valve stem slidably extending through the transverse wall with a first portion protruding beyond the proximal side thereof and a second portion disposed in proximal relationship to the diaphragmic valve member, such that depression of the stem causes resilient deflection of the diaphragmic valve member out of sealing engagement with the transverse wall, thereby permitting fluid flow between and through the valve member opening and the transverse wall member opening.

The other valve housing has a stem opposing surface disposed in engageable axial alignment with the stem first portion and a normally closed valve mechanism having a resiliently displaceable valve closer. The displaceable valve closure is disposed in engageable axial alignment with the valve displacement member. Upon engagement of the housings, the stem opposing surface depresses the stem and the valve displacement member depresses the closure to permit fluid flow through the dispensing assembly.

DETAILED DESCRIPTION OF THE PREFERRED EMBODIMENT

Figure 1:
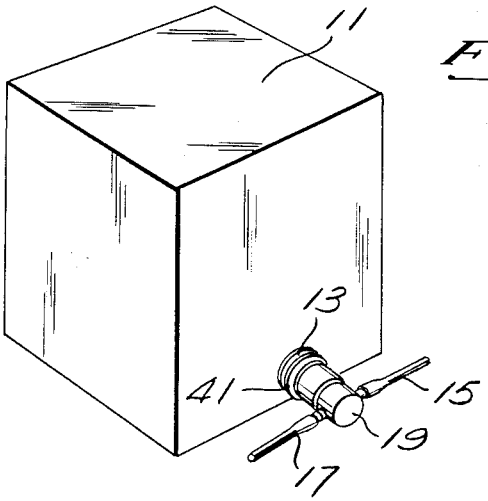
FIG. 1 is a perspective view of a fluid dispensing assembly of the present invention mounted on a bag-in-box fluid container.

Referring to FIG. 1, container 11 represents a typical bag-in-box container and may contain any of a variety of fluids such as wine, juices, soda syrup and the like. The dispenser assembly of the present invention is shown connected to spout 13 of container 11 and is adapted to be in fluid communication with fluid passageways 15 and 17. The use of plural fluid passageways allows interconnection of a plurality of containers, any of which may be disconnected without interfering with fluid flow from the remaining containers through the passageways. It is of course understood that the dispensing assembly may be used in connection with a single fluid passageway with the use of an L-shaped assembly or with a single fitting axially extending from the dispensing assembly.

Figure 2:
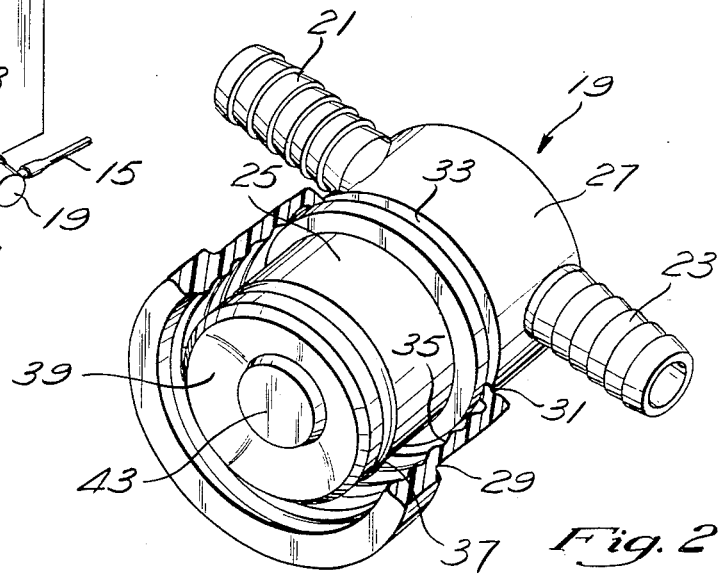
FIG. 2 is a bottom perspective view of the of the connector valve of the fluid dispensing assembly with the valve housing partially cut away.

FIG. 2 illustrates a bottom perspective of the connector valve 19 of the fluid dispensing assembly. Connector valve head 27 is provided with fittings 21 and 23 for interconnection to plural fluid passageways 15 and 17. If only one fluid passageway is to be used, the remaining fitting may be sealed with a plastic cap or the like. Cylindrical housing 25 extends axially from the valve head 27 and houses the connecting valve mechanism. Cylindrical housing 25 may be integral with valve head 27 or may be a separate structure connected thereto, as shown in more detail at FIG. 5. Collar 29 is rotatably disposed about housing 25 and includes flange 31 which connects the collar to the connector valve by engagement with recess 33. The inner surface of collar 29 is preferably provided with threads 35 to facilitate mating the connector valve to the container valve. It is of course understood that other coupling structures may be used in place of threaded collar 29. For example, instead of threads, collar 29 may be adapted for twist lock connection to the container valve or the like. Also, for example, mating means may be provided about the surface of cylindrical housing 25 to secure the housing to the container valve 41. One practical advantage of the rotatable collar construction is that it permits the connecting valve 19 to engage the container valve 41 without the necessity of rotating the connector valve head 27. Thus, the connector valve and container valve may be engaged without the need to disconnect the fluid passageways.

O-ring 37 is provided about the surface of housing 25 in order to facilitate a fluid tight seal upon engagement with the container valve 41. Connector valve housing 25 has an axial bore on its bottom surface 39 in which a spring biased displaceable valve closure 43 is disposed. Upon coupling to the container valve 41, bottom surface 39 of connector valve 19 is disposed proximal to the container valve surface 55. Closure 43 normally forms a fluid tight seal with the bottom surface 39 and is adapted to be axially distally displaced upon mutual engagement of the connector valve and the container valve, thereby permitting fluid flow from the container through bore 45, through cylindrical housing 25, through valve head 27 and to the fluid passageways via fittings 21 or 23. Though it is anticipated that the various components of connector valve 19 may be constructed of any of a number of materials, it is preferred to use lightweight plastic materials, such as polyethylene and the like. These materials are particularly advantageous from an economic and weight perspective and are fully satisfactory from a performance point of view.

Figure 3:
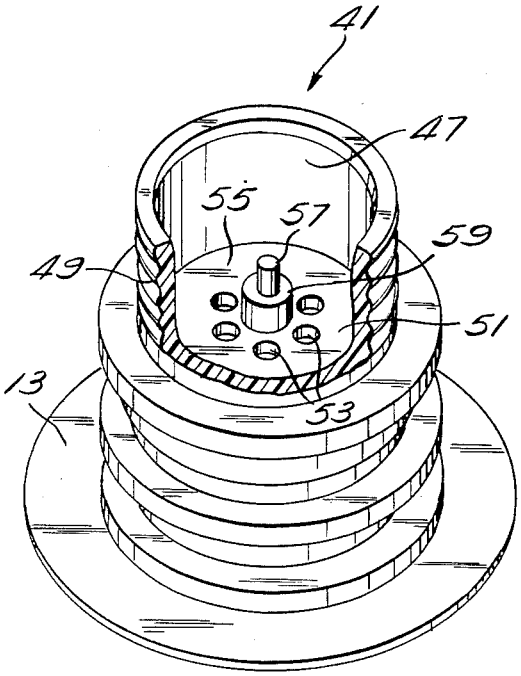
FIG. 3 is a top perspective view of the container valve of the fluid dispensing assembly connected to the container spout with the valve housing partially cut away.

FIG. 3 is a top perspective view of the container valve 41 of the fluid dispensing assembly as connected to container spout 13. Container valve 41 includes container valve housing 47, which is preferably of a cylindrical shape and having an inner chamber adapted to receive connector valve housing 25. The outer surface of connector valve housing 47 is preferably provided with threads 49 on its outer surface to threadably engage connector valve collar 29. The container valve housing 47 is also adapted to engage spout 13, which is in turn connected to container 11, as shown in FIG. 1. In practice, connector valve 41 may be formed integrally with container spout 13 or may be a separate article. Preferably, the container valve is formed separately from spout 13 to facilitate ease of manufacture and filling of container 11. It is also anticipated that connector valve 41 may be produced in various sizes amnd may serve as an adaptor to interface different sized spouts to one or more sizes of connector valves. Though it is anticipated that the various components of container valve 19 may also be constructed of any of a number of materials, it is preferred to use lightweight plastic materials, such as polyethylene and the like, as explained above with respect to connector valve 19.

Figure 4:
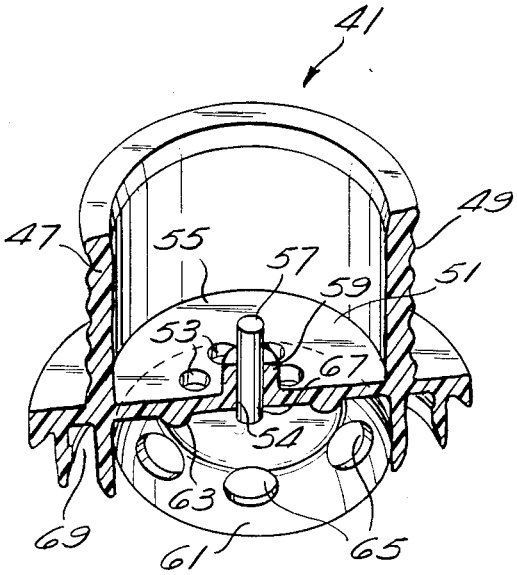
FIG. 4 is a top perspective view of the diaphragm and a cross-sectional portion of the container valve of FIG. 3.

As shown in FIGS. 3 and 4, container valve 47 includes transverse wall 51 which has a series of fluid openings 53 therethrough. In the preferred embodiment shown in FIGS. 3 and 4, transverse wall 51 includes a plurality of fluid openings 53, as well as a central opening 54 adapted to receive valve stem 57.

While central opening 54 may be sufficiently large to allow fluid flow about valve stem 57 and thereby eliminate the need for fluid openings 53, in the preferred construction central opening 54 is adapted to closely engage valve stem 57 and form a fluid tight seal therebetween. That construction provides greater support for valve stem 57 and therefore improves the durability and functional reliability of the container valve 41.

The proximal surface 55 of transverse wall 51 is provided with a valve displacement member 59 extending from surface 55. Upon mutual engagement of the connector valve 19 and the container valve 41, valve displacement member 59 is disposed in axial alignment with connector valve closure 43. Thus, as the connecting valve 19 and the container valve 41 become engaged, valve displacement member 59 abuts against connecting valve closure 43 causing displacement of the valve closure 43 and thereby opening a normally closed passageway through connecting valve 19.

As shown in FIG. 4, transverse resilient diaphragmic sealing valve member 61 is mounted in container valve housing 47 adjacent to the distal side of transverse wall 51. Diaphragmic valve member 61 has a series of fluid openings 65 therethrough. The diaphragmic valve member 61 is adapted to abut against and form a fluid tight seal with the distal side of transverse wall 51, preferrably with annular rib 63 depending from the distal side of transverse wall 51. The fluid openings of the transverse wall 51 and the fluid openings of diaphragmic valve member 61 are disposed on different sides of annular rib 63 to prevent fluid flow during sealing. It should be understood that, although in the preferred embodiment the transverse wall openings are disposed within annular rib 63 and the diaphragmic valve member openings 65 are disposed outwardly from annular rib 63, a reversal of the positions of the respective fluid openings would produce a satisfactory valve mechanism. The alternative arrangement would, however, require that the circumference of diaphragmic valve 61 be in fluid tight engagement with the container valve housing 47.

The lower end 67 of valve stem 57 is disposed in proximal relationship to diaphragmic valve member 61. Preferably, valve stem 57 is adapted to slidably extend through transverse wall 51 and protrude from the proximal surface of the transverse wall. In practice, valve stem 57 is desirably formed integrally with diaphragmic valve member 61. If valve stem 57 is formed separately from the diaphragmic valve member 61, it is anticipated that an annular ring or the like would be provided about the lower end of valve stem 57 to insure that the valve stem remains within the transverse wall opening.

Though the valve stem 57 is preferably disposed within a collar defined by valve displacement member 59, it is understood that the valve stem may be remote from valve displacement member 59. In one such alternate embodiment, the valve stem may be formed as an annular ring or collar extending through transverse wall 51 and adapted to displace the diaphragmic valve member upon engagement of the connector valve and the container valve. In a preferred embodiment, as shown in FIG. 4, the diaphragmic valve member 61 is made of a thin resilient material, such as plastic, and is generally dome-shaped. This construction insures a tight seal between member 61 and rib 63 by maintaining a biasing force of member 61 against rib 63 when there is no depressing force on stem 57. Other useable means for displacing the seal between transverse wall 51 and diaphragmic valve member 61 will be obvious to those of ordinary skill in the art.

As also shown in FIG. 4, container valve housing 47 is provided with annular recess 69 which is adapted to receive and engage the upper lip of spout 13 for mounting container valve 41 thereon.

Figure 5:
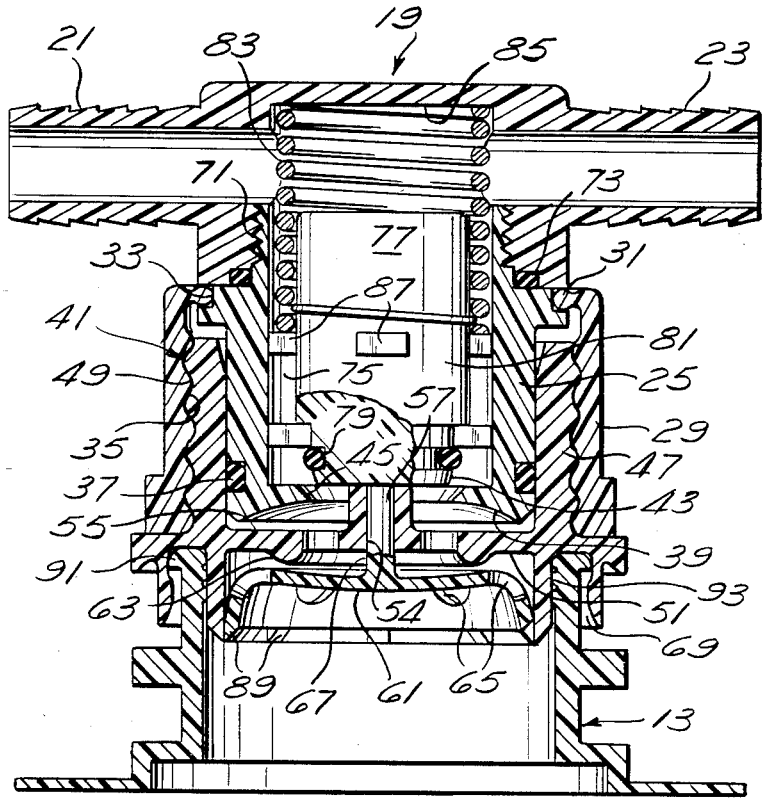
FIG. 5 is a side cross sectional view of the fluid dispensing assembly in the engaged fluid flow position.
Figure 6:
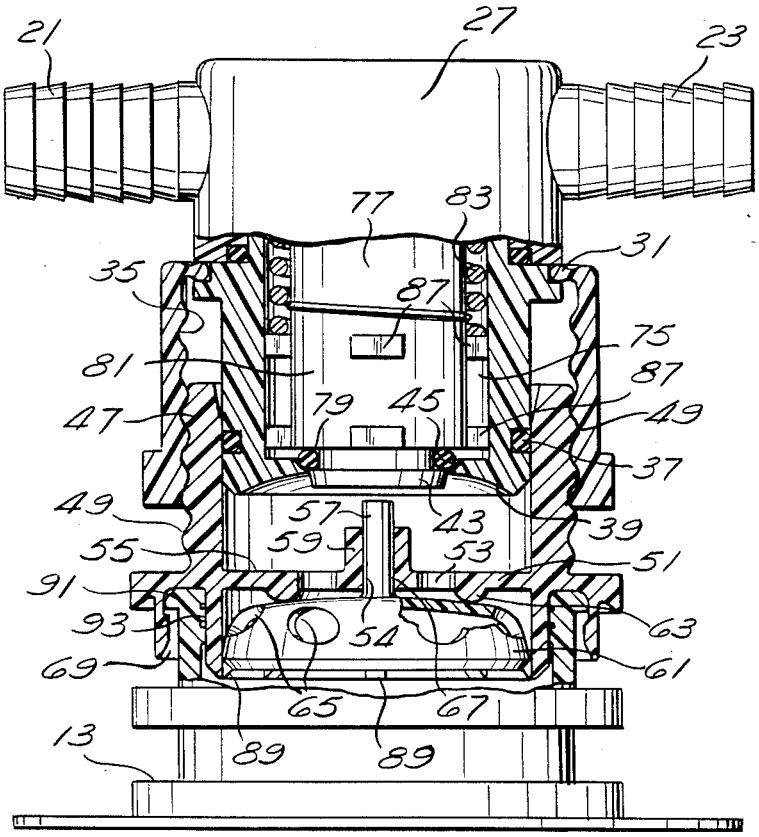
FIG. 6 is a side cross sectional view of the connector and container valves of the fluid dispensing assembly aligned but unengaged.

FIG. 5 is a cross sectional view of the fluid dispensing assembly illustrating the connector valve and the container valve in the engaged fluid flow position. FIG. 6 illustrates a similar view with the connector valve and container valve in the unengaged, closed position. As shown most clearly in FIGS. 5 and 6, valve head 27 may be formed separately from container valve housing 25 and connected to housing 25 by any convenient means such as threaded means 71. O-ring 73 is provided to facilitate interconnection between the valve head and housing 25. Within housing 25 is cylindrical chamber 75. Disposed within chamber 75 is a displaceable plunger mechanism 77 which may be a spring biased bullet valve mechanism well known in the art. Plunger mechanism 77 serves to bias displaceable valve closure 43 in the normally closed position against bore 45. O-ring 79 is disposed about the displaceable valve closure 43 to facilitate sealing engagement with bore 45. Plunger body 81 is connected to valve closure 43 and adapted for displacement when the valve closure is axially moved from its normal closed position. Spring mechanism 83 is secured about plunger 81 and serves to bias the plunger and the valve closure in the normally closed position. The upper surface of spring mechanism 83 preferably abuts against inner surface 85 of valve head 27. In an alternative construction, the fluid passageway through valve head 27 may include a rigid member across the upper surface of chamber 75, against which spring mechanism 83 may abut. The size and resiliency of spring mechanism 83, and the size of plunger 77 may be a matter of design choice in view of the intended application of the fluid dispensing assembly.

As shown, plunger 81 is provided with extensions 87 which extend from plunger 81 and abut against the inner surface of connector housing 25. Extensions 87 serve to guide the movement of plunger 81 within chamber 75. Spces between extensions 87 allow a flow of fluid through chamber 75 and into the fluid passageway. Alternatively, extensions 87 may be replaced by a perforated or notched washer adapted to be mounted upon plunger 81 and to abut against all or some portion of the inner surface of housing 25. The perforations or spaces between portions of the washer would serve to facilitate fluid flow through housing 25 in an equivalent manner. One or more such washers may be provided along the length of plunger 81.

The container valve illustrated at FIGS. 5 and 6 includes an annular rib 89 disposed about the lower inner surface of the container vlve housing 47. Rib 89 serves to secure diaphragmic valve member 61 within the container valve housing and insure sealing engagement between the diaphragmic valve member 61 and rib 63 of the transverse wall. It is understood that the container valve housing may extend beyond the location of annular rib 89 if desired.

The upper portion 91 of spout 13 engages container housing 47 within recess 69. Ribs or grooves 93 may be provided on the exterior surface of the container housing or interior surface of the spout in order to further secure engagement of the container housing and the spout.

As collar 29 is secured to container housing 49, the surface of valve closure 43 is brought into contact with valve stem 57 and depresses the valve stem. Upon depression of the valve stem the seal between diaphragmic valve member 61 and annular rib 63 is displaced, allowing fluid flow through the diaphragmic valve member openings, between the diaphragmic valve member and annular rib 63, and through transverse wall openings 53.

Further engagement of collar 29 to the container valve housing causes valve closure 43 to abut against and be displaced by valve displacement member 59 within the container valve housing. Fluid flow through the container valve housing may then pass through bore 45, about valve mechanism 77 to the fluid passageways via the fluid passageway fittings 21 and/or 23.

Thus, the present invention allows mutual engagement and dual valve openings in response to a single attachment step. Similarly, a single disconnection step will close both valve openings, thereby minimizing leakage or drip in the course of the disengagement process. In practice, that advantageous construction eliminates a dripping problem when the connector valve is disconnected from one container and connected to another container in its place. Problems associated with leakage of messy or sticky fluids, such as soda syrup, are thereby eliminated. Moreover, the use of the fluid passageway fittings permits easy connection to a mixing chamber or the like where fluid from the connecting valve is mixed with another material. It is anticipated that the connecting valve may, for example, lead to a mixing chamber to combine a stream of carbonated water with soda syrup from a container to discharge carbonated soda to a final dispensing mechanism, such as at a soda fountain. If desired, a regulating valve may be connected to the connecting valve passageway to control the mix of fluids discharged from the connecting valve.

Accordingly, the present invention provides a lightweight, simple, inexpensive and reliable fluid dispensing device for providing continuous fluid dispensing from a container to a fluid passageway. As will be obvious to those of ordinary skill in the art, various other modifications or embellishments of the preferred embodiment of the invention described herein may be accomplished without departing from the scope or the spirit of the invention which is only defined by the claims set forth below.

What is claimed is:

1. A fluid dispensing assembly for continuous dispensing of fluid from a fluid container to a fluid passageway comprising:

a connector valve adapted to be in fluid communication with the passageway and a container valve adapted to be in fluid communication with the container, the valves being mutually engageable and adapted to open upon engagement to permit fluid flow from the container through the valves to the passageway;

each of the valves comprising a cylindrical housing open to fluid flow therethrough, the housings having proximal ends and being adapted for mutual locking engagement to permit fluid flow therebetween, the container valve housing having a distal end adapted for mounting to the container, and the connector valve housing having a distal end adapted for fluid flow engagement wwith the fluid passageway;

one of the valve housings having an intermediate transverse wall, with at least one fluid opening therein; a valve displacement member extending from the proximal side of the wall; a transverse resilient diaphragmic sealing valve member mounted in the housing adjacent the transverse wall in sealing engagement therewith to prevent fluid flow through the transverse wall opening, the diaphragmic valve member having at least one fluid opening therein radially displaced from the transverse wall opening; and a valve stem slidably extending through the transverse wall member and having a first portion protruding beyond the proximal side of the wall, and a second portion disposed in proximal relationship to the diaphragmic valve member such that depression of the stem causes resilient deflection of the diaphragmic valve member out of sealing engagement with the transverse wall to permit fluid flow between and through the valve member opening and the transverse wall opening; and the other valve housing comprising a stem opposing surface disposed in engageable axial alignment with the stem first portion and a normally closed valve mechanism having a resiliently displaceable valve closure, disposed in engageable axial alignment with the valve displacement member such that upon engagement of the housings the the stem opposing surface depresses the stem and the valve displacement member displaces the closure to permit fluid flow through the dispensing assembly.

2. The fluid dispensing assembly as recited in claim 1 wherein one of the valve housings is in the container valve housing.

3. The fluid dispensing assembly as recited in claim 1 wherein the valves are threadably engageable.

4. The fluid dispensing assembly as recited in claim 1 further comprising a container spout in fluid communication with the container and adapted to engage and form a fluid tight seal with the container valve housing.

5. The fluid dispensing assembly as recited in claim 1 wherein the transverse wall includes an annular rib disposed on the distal surface thereof, the rib being adapted to normally abut against and form a fluid tight seal with the diaphragmic valve member.

6. The fluid dispensing assembly as recited in claim 5 wherein one of the transverse wall opening and the diaphragmic valve member opening is disposed within the annular rib.

7. The fluid dispensing assembly as recited in claim 6 wherein the transverse wall opening is disposed within the annular rib.

8. The fluid dispensing assembly as recited in claim 7 wherein the diaphragmic valve member opening is disposed outside of the circumference of the annular rib.

9. The fluid dispensing assembly as recited in claim 8 wherein the container valve housing is provided with an annular rib on its inner surface disposed in sealing engagement with the diaphragmic valve member on its distal side.

10. The fluid dispensing assembly as recited in claim 9 wherein the diaphragmic valve member is a domed shaped member.

11. The fluid dispensing assembly as recited in claim 10 wherein the diaphragmic valve member and the valve stem are integral.

12. The fluid dispensing assembly as recited in claim 11 wherein the transverse wall and the valve displacement member are integral.

13. The fluid dispensing assembly as recited in claim 1 wherein the normally closed valve mechanism of said other valve housing comprises a bullet valve mechanism.

14. The fluid dispensing assembly as recited in claim 1 wherein the connector valve is provided with plural fluid passageway connecting fittings.

15. The fluid dispensing assembly as recited in claim 14 wherein the valve stem and the collar form a fluid tight seal therebetween.

16. The fluid dispensing assembly as recited in claim 1 wherein the valve displacement member forms a collar and the valve stem is disposed to extend through the collar.

17. The fluid dispensing assembly as recited in claim 1 wherein the transverse wall is provided with plural fluid openings.

18. The fluid dispensing assembly as recited in claim 1 wherein diaphragmic valve member is provided with plural fluid openings.

19. The fluid dispensing assembly as recited in claim 1 wherein the stem opposing surface forms a portion of the displaceable valve closure.

20. A fluid dispensing assembly comprising:

a connector valve adapted to be in fluid communication with a fluid discharge passageway, the connector valve having a bullet valve disposed therein, the bullet valve including a displaceable valve closure;

a container valve having an upper outer portion adapted to engage the connecting valve and a lower outer portion adapted to engage a container spout, the container valve comprising a chamber having a transverse wall with at least one fluid opening therethrough, the wall having a proximal side and a distal side, the distal side of the wall including an annular rib depending from the wall and circumscribing said fluid opening in the wall, a resilient diaphragm disposed within the container valve abutting the annular rib and forming a fluid-tight seal therewith, the diaphragm including at least one fluid opening disposed outside of the annular rib, a circular collar disposed on the proximal side of the transverse wall, the collar being adapted to displace the valve closure of the connector valve upon mutual engagement of the container valve and the connector valve; and a displaceable stem disposed within the collar and extending through the transverse wall, the stem being displaceable upon engagement of the container valve and the connector valve, whereupon contact with the valve closure causes the stem to displace the diaphragm and thus the seal between the diaphragm and the annular rib.

21. A fluid dispensing assembly comprising:

a connector valve adapted to be in fluid communication with a fluid discharge passageway, the connector valve comprusing a cylindrical housing including a bottom surface having an axial bore, a spring-biased plunger within the housing and having a lower portion adapted to sealingly abut against the bottom surface of the axial bore;

a container valve comprising an upper portion adapted to engage the connector valve, and a lower outer portion adapted to engage a dispenser spout, the container valve further comprising a transverse wall, having plural fluid openings therethrough, the wall further having a proximal side and a distal side, the proximal side having a central collar extending therefrom, the distal side of the wall including an annular rib depending therefrom and circumscribing the fluid openings in the wall, the container valve further including a valve stem extendable through the wall and a resilient diaphragm disposed adjacent the distal side of the wall against the annular rib, so as to normally form a fluid-tight seal therebetween, the diaphragm having plural fluid openings therethrough, the openings of the diaphragm being disposed outside of the annular rib, the fluid-tight seal being displaceable upon mutual engagement of the connector valve and the container valve such that the stem contacts the valve closure of the connector valve and is thereby pushed through the collar to displace the diaphragm, the engagement further being operative to displace the valve closure from sealing engagement with the axial bore upon abutment of the plunger against the collar.

* * * * *